US008573020B2

(12) United States Patent
Stodd

(10) Patent No.: US 8,573,020 B2
(45) Date of Patent: Nov. 5, 2013

(54) METHOD AND APPARATUS FOR FORMING A CAN SHELL

(75) Inventor: R. Peter Stodd, Vandalia, OH (US)

(73) Assignee: Container Development, Ltd., Dayton, OH (US)

( * ) Notice: Subject to any disclaimer, the term of this patent is extended or adjusted under 35 U.S.C. 154(b) by 427 days.

(21) Appl. No.: 12/924,077

(22) Filed: Sep. 20, 2010

(65) Prior Publication Data

US 2012/0067102 A1 Mar. 22, 2012

(51) Int. Cl.
*B21D 28/00* (2006.01)
*B21D 22/00* (2006.01)

(52) U.S. Cl.
USPC ..... 72/336; 72/348

(58) Field of Classification Search
USPC ..... 72/336, 347, 348, 350, 379.4; 413/8, 56
See application file for complete search history.

(56) References Cited

U.S. PATENT DOCUMENTS 4,713,958 A 12/1987 Bulso, Jr. et al.
4,716,755 A 1/1988 Bulso, Jr. et al.
4,808,052 A 2/1989 Bulso, Jr. et al.
4,955,223 A 9/1990 Stodd et al.
5,046,637 A * 9/1991 Kysh ..... 220/610
5,187,966 A * 2/1993 Seconde et al. ..... 72/329
5,685,189 A * 11/1997 Nguyen et al. ..... 72/348
6,658,911 B2 12/2003 McClung
7,302,822 B1 12/2007 Turnbull et al.
7,341,163 B2 3/2008 Stodd
7,464,576 B2 * 12/2008 Turner et al. ..... 72/350
7,478,550 B2 * 1/2009 Wynn et al. ..... 72/348
7,500,376 B2 * 3/2009 Bathurst et al. ..... 72/348
8,141,406 B2 * 3/2012 Stodd ..... 72/348
2005/0029269 A1 2/2005 Stodd et al.

* cited by examiner

*Primary Examiner* — Edward Tolan
(74) *Attorney, Agent, or Firm* — Jacox, Meckstroth & Jenkins

(57) ABSTRACT

Can shells are produced with tooling installed on a mechanical press, and the tooling includes an upper retainer supporting a blank and draw die enclosing an outer pressure sleeve and an inner pressure sleeve surrounding a die center punch, all having pistons. An air chamber is connected by air spring passages to the inner pressure sleeve piston, and the outer pressure sleeve receives the same air as the air chamber or lower pressure air. The die center punch has an insert which initiates the drawing of a cup, and the inner pressure sleeve and die center punch have contoured surfaces which mate with opposing surfaces on a die core ring to form and clamp the chuckwall of the shell during downstroke of the press. A panel punch has peripheral surfaces which form the panel wall and countersink of the shell during upstroke of the press.

8 Claims, 7 Drawing Sheets

METHOD AND APPARATUS FOR FORMING A CAN SHELL

BACKGROUND OF THE INVENTION

This invention relates to the method and apparatus for forming a can shell from sheet metal or sheet aluminum, for example, such as the methods and apparatus or tooling disclosed in U.S. Pat. Nos. 4,713,958, 4,716,755, 4,808,052, 4,955,223, 6,658,911 and 7,302,822. The disclosures of these patents are herein incorporated by reference to supplement the detail description of the present invention.

In such tooling assembly or apparatus, it has been found desirable for the apparatus to be constructed for use in a single action mechanical press such as disclosed in above mentioned U.S. Pat. Nos. 4,955,223 and 7,302,822 and also for use in a double action mechanical press, for example, as disclosed in above-mentioned U.S. Pat. Nos. 4,716,755 and 6,658,911. A single action high speed press is simpler and more economical in construction and is more economical in operation and in maintenance and can be operated effectively and efficiently, for example, with a stroke of 1.75 inch and at a speed of 650 strokes per minute. There are also many more single action high speed presses in use in the field than there are double action presses.

It has also been found desirable for the apparatus or tooling assembly to incorporate an inner pressure sleeve and an outer pressure sleeve and to operate both sleeves with air pressure, but avoid actuating the inner pressure sleeve with circumferentially spaced and axially extending springs, for example, as disclosed in U.S. Pat. No. 7,302,822 or the use of circumferentially spaced and axially extending pins, for example, as disclosed in U.S. Pat. No. 4,716,755. The high speed axial reciprocating movement of the pins and the single piston which actuates the pins create undesirable additional heat, and is difficult to produce an adjustable and precisely controllable axial force on the inner pressure sleeve with the use of compression springs.

It is further desirable to have a precisely controllable constant force exerted by the outer pressure sleeve on the sheet material to avoid thinning the material between the outer pressure sleeve and the die core ring during high speed operation of the press. Precisely controllable air pressure on the inner pressure sleeve is also desirable for holding the inner crown wall and chuckwall of the can shell while forming the countersink, panel wall and center panel of the can shell without thinning the sheet metal. In addition, it is desirable to minimize the vertical height of the tooling assembly for producing can shells in order to accommodate more single action high speed presses existing in the field and to operate at higher speeds with less heat being generated so as to avoid the use of water cooled tooling components. After reviewing the above patents, it is apparent that none of the patents provide all of the above desirable features.

SUMMARY OF THE INVENTION

The present invention is directed to improved method and apparatus or tooling for high speed production of can shells and which provide all of the desirable features mentioned above. The tooling assembly of the invention is also ideally suited for producing a can shell such as disclosed in applicant's U.S. Pat. No. 7,341,163 and in applicant's published patent application No. US-2005-0029269, the disclosures of which are also herein incorporated by reference. The method and apparatus or tooling assembly of the invention are especially suited for use on a single or double action press and for producing uniform and precision can shells at a high rate of speed and with the minimum generation of heat in order to avoid thermal changing of the tooling assembly during operation.

In accordance with one illustrated embodiment of the invention, a can shell is formed by a tooling assembly including an annular inner pressure sleeve which is located within an annular outer pressure sleeve, and both of the sleeves have integral pistons within corresponding annular air piston chambers. The outer pressure sleeve is supported within an annular blank and draw die secured to an upper retainer mounted on an upper die shoe of a single or double action press. The retainer also supports a die center piston which may be supported for relative axial movement, and the die center piston supports a die center punch within the inner pressure sleeve. The die center piston defines a chamber supplied with air through a port at a controlled higher pressure. The air chamber is connected to the air piston chamber for the inner pressure sleeve by a plurality of circumferentially spaced elongated air spring passages. The air piston chamber for the outer pressure sleeve is supplied with air at a controlled substantially lower pressure through a separate port in the upper retainer.

The die center punch carries an adjustable punch insert which initiates the draw of a cup within a die cut sheet metal disk held between the outer pressure sleeve and an opposing fixed die core ring supported by a lower retainer mounted on a fixed lower die shoe of the press. The inner pressure sleeve and the opposing die core ring have mating contoured surfaces which form an annular inner crown wall and an upper chuckwall portion of the shell. An annular skirt portion of the die center punch extends around the punch insert and has a contoured surface which mates with a contoured surface on the die core ring to form a lower portion of the chuckwall while the punch insert completes the drawing of the cup. The opposing panel punch has a peripheral contoured surface which forms the center panel, an annular inclined panel wall and the annular countersink as the die center punch returns to its home position. In another embodiment of the invention, the annular air piston chamber for the outer pressure sleeve is connected by air passages to the air spring passages, and the air piston chamber for the inner pressure sleeve and the air piston chamber for the outer pressure sleeve receive the same controllable air supply pressure, thereby avoiding the need for different air supplies at different pressures to operate the tooling assembly on the movable die shoe.

Other features and advantages of the invention will be apparent from the following description, the accompanying drawings and the appended claims.

DESCRIPTION OF THE PREFERRED EMBODIMENTS

Figure 11:
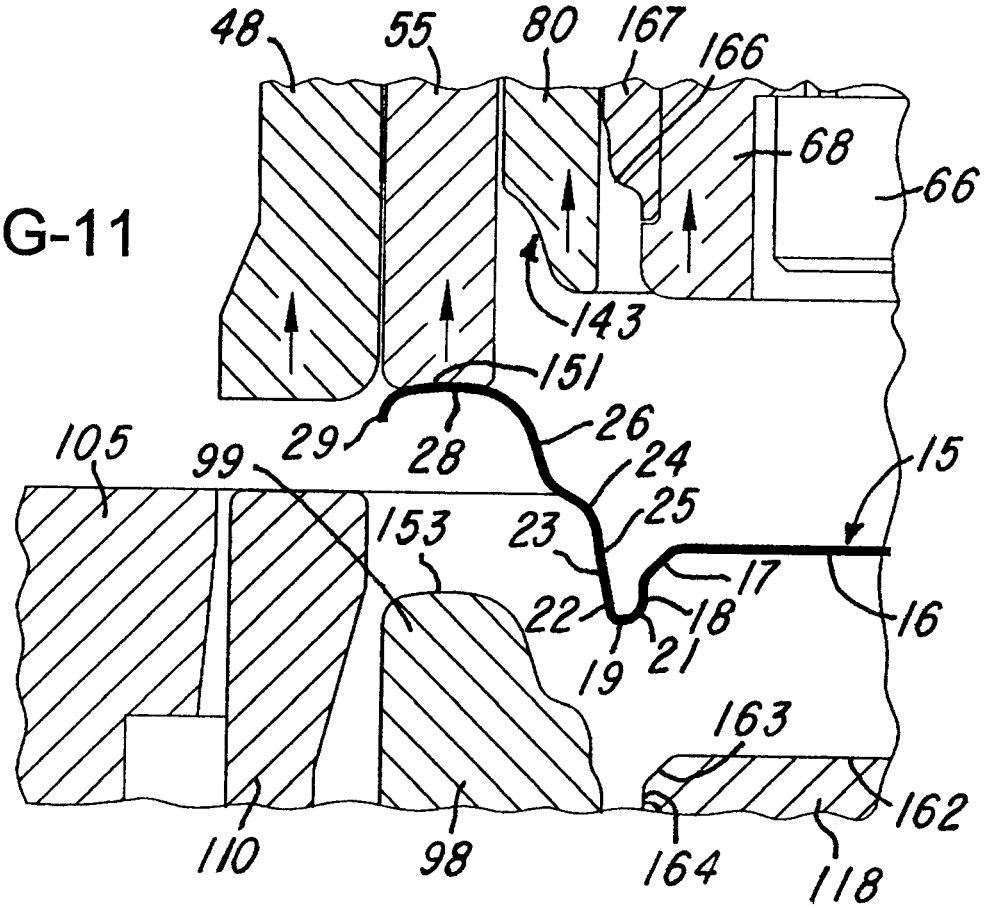

Referring to FIG. 11, a greatly enlarged shell 15 is formed from sheet metal or aluminum having a thickness of about 0.0082 inch. The shell 15 includes a flat circular center panel 16 which is connected by a frusto-conical or inclined annular panel wall portion 17 and a substantially cylindrical panel wall portion 18 to an annular countersink 19 having an inclined or frusto-conical inner wall portion 21 and a generally U-shaped cross-sectional configuration. The countersink 19 also has a slightly inclined annular outer wall portion 22 connected to an annular inclined lower chuckwall portion 23 which is connected to an upwardly curved upper chuckwall portion 24 by a slight angular break 25. The curved upper wall portion 24 of the chuckwall connects with an inclined or frusto-conical annular inner wall portion 26 of a crown portion 28 having a downwardly curved outer peripheral lip portion 29. The cross-sectional configuration or profile of the shell 15 is more specifically disclosed in applicants' above-mentioned published patent application No. US-2005-0029269. However, the method and apparatus of the invention may also be adapted to produce shells having different profiles in axial cross-section.

Figure 1:
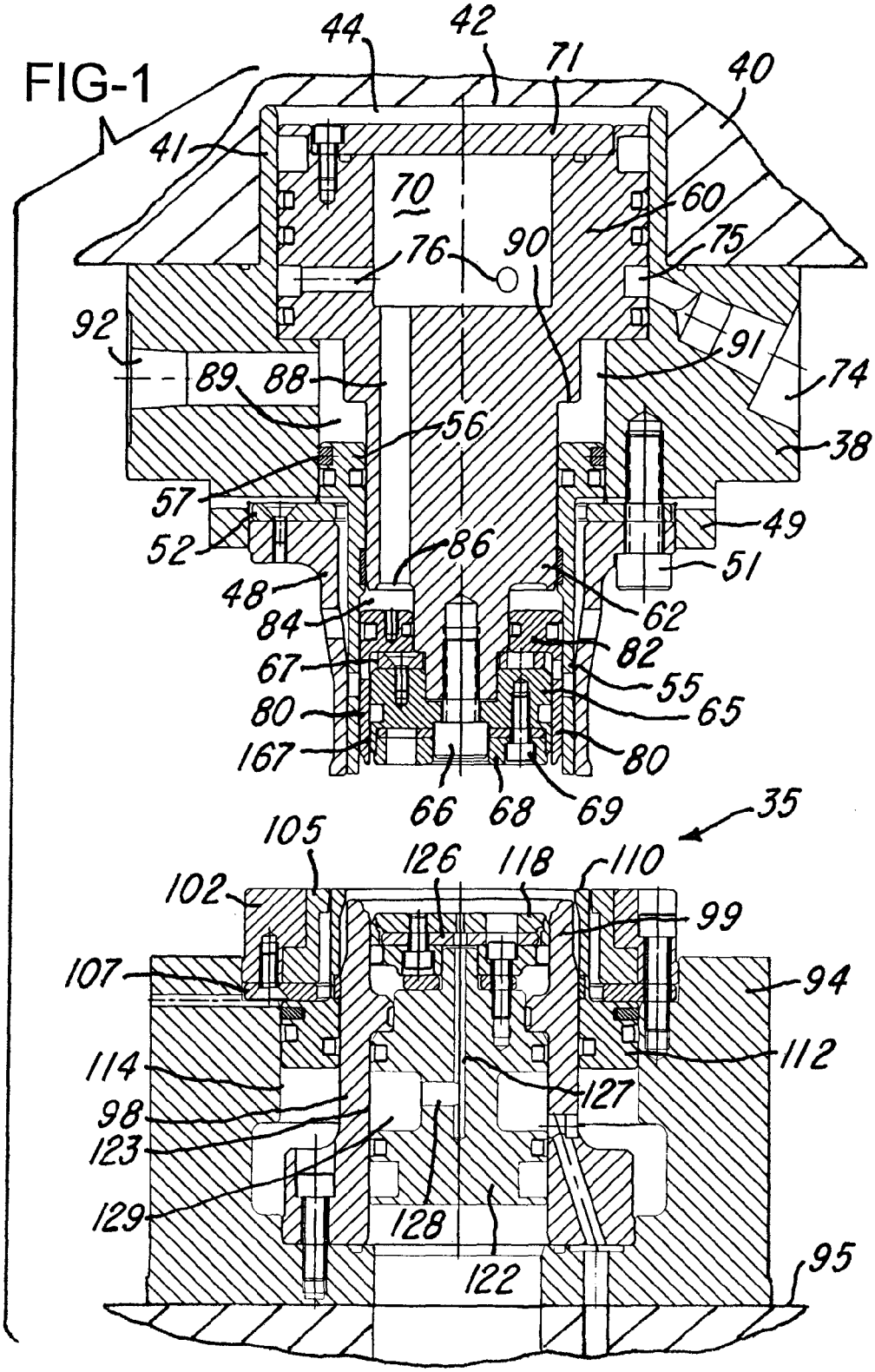
FIG. 1 is an axial section of a tooling assembly constructed and operated in accordance with the invention.

Referring to FIG. 1, a tooling assembly 35 includes an annular upper retainer 38 which is mounted on an upper die shoe 40 of a single or double action mechanical press. The retainer 38 has a cylindrical portion 41 which projects upwardly into a mating cavity 42 within the upper die shoe 40 and defines a pressurized air chamber 44. An annular blank and draw die 48 has an outwardly projecting upper flange portion 49 which is secured to the retainer 38 by a set of circumferentially spaced screws 51. A flat ground annular spacer 52 is secured to the upper flange portion of the blank and draw die 48 and provides for precisely spacing the die 48 axially relative to the upper retainer 38.

An annular outer pressure sleeve 55 is supported for axial movement within the blank and draw die 48 and includes an integrally formed piston 56 having radial plastic wear pins 57. A die center piston 60 is supported for axial movement within the upper retainer 38 and includes a lower portion 62 which supports a die center punch 65 removably secured to the die center piston 60 by a center cap screw 66. A flat ground annular hard spacer 67 is positioned between the die center punch 65 and a shoulder on the lower portion 62 of the die center piston 60 to provide for precisely selecting the axial position of the die center punch 65 on the die center piston 60. An annular punch insert 68 forms the end of the die center punch 65 and is secured by a set of peripherally spaced cap screws 69. A cylindrical pressurized air reservoir chamber 70 is formed within the center portion of the die center piston 60 and is closed at the top by a cap plate 71. The reservoir chamber 70 receives pressurized air through a port 74 formed within the retainer 38 and connected to an annular groove 75 and a set of radial passages 76 formed within the die center piston 60.

An annular inner pressure sleeve 80 is supported for axial movement within the outer pressure sleeve 55 and includes an integral piston 82 confined within an annular air piston chamber 84 defined between the piston 82 and a radial shoulder 86 on the lower portion 62 of the die center piston 60. The air piston chamber 84 receives pressurized air through a plurality of three circumferentially spaced air passages 88 which extend axially from the shoulder 86 to the air reservoir chamber 70 within the die center piston 60. Suitable two-piece air seal rings are carried by the piston 82 of the inner pressure sleeve 80 and also by the piston 56 of the outer pressure sleeve 55 as well as by the upper portion of the die center piston 60. The piston 56 of the outer pressure sleeve 55 is confined within an annular air pressure chamber 89 which extends to a stop shoulder 90 and connects with an annular air chamber 91. The chambers 89 & 91 receive pressurized air through a port 92 in the retainer 38.

The tooling assembly 35 also includes a fixed annular lower retainer 94 which is mounted on a stationery lower die shoe 95 of the single or double action press. The lower retainer 94 supports a fixed die core ring 98 having an annular upper portion 99 and also supports a fixed annular retainer 102 which receives and confines an annular cut edge die 105. A flat annular ground spacer 107 is secured to the retainer 102 to confine the cut edge die 105 and provides for precisely positioning the cut edge die axially with respect to the upper annular portion 99 of the die core ring 98. An annular lower pressure sleeve 110 is positioned between the cut edge die 105 and the upper portion 99 of the die core ring 98 and has an integral piston 112 supported for axial movement within an annular pressurized air pressure chamber 114 defined between the lower retainer 94 and die core ring 98. The chamber 114 receives pressurized air through a port (not shown) within the lower retainer 94.

A circular panel punch 118 is positioned within the upper portion 99 of the die core ring 98 and is secured for axial movement with a panel punch piston 122 supported within a stepped cylindrical bore 123 formed within the die core ring 98. A flat annular ground spacer 126 is positioned between the panel punch 118 and the panel punch piston 122 to provide for precisely positioning the panel punch 118 axially on the piston 122. Suitable two piece air seal rings are carried by the lower pressure sleeve piston 112 and the panel punch piston 122 to form sliding air-tight seals. An axially extending air pressure passage 127 is formed within the center of the panel punch piston 122 and receives pressurized air through a cross passage 128 and an annular chamber 129. The passage 127 provides a jet of pressurized air upwardly through a center opening within the panel punch 118 for holding the shell 15 against the outer pressure sleeve 55 as the sleeve moves upwardly near the end of the pressed stroke, as shown in FIG. 11, to provide for rapid lateral removal of the completed shell in a conventional manner.

Figure 2:
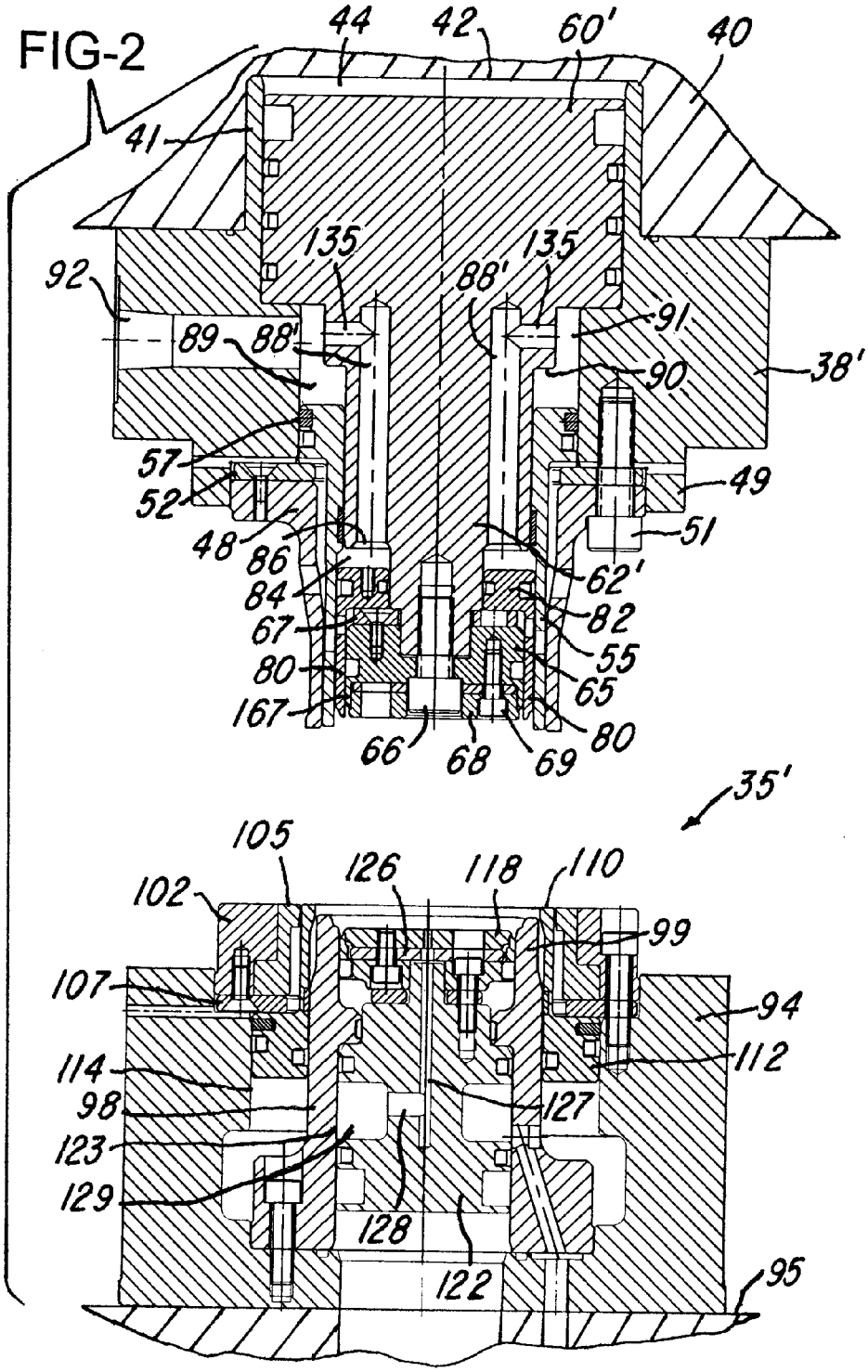
FIG. 2 is an axial section of the tooling assembly shown in FIG. 1 and constructed and operated in accordance with a modification or another embodiment of the invention.

Referring to FIG. 2, a modified tooling assembly 35' is constructed the same as the tooling assembly 35 except that the die center piston 60' does not have the internal chamber 70. Instead, the air spring passages 88' receive pressurized air through radial passages 135 connected to the annular chamber 91 which receives pressurized air through the port 92. This pressurized air may be on the order of 125 to 170 p.s.i. so that the same air pressure is applied against the piston 56 of the outer pressure sleeve 55 and the piston 82 of the inner pressure sleeve 80. In comparison with the tooling assembly 35 of FIG. 1, the air reservoir chamber 70 receives pressurized air through the port 74, annular chamber 75 and passages 76 on the order of 160 to 170 p.s.i., whereas the piston 56 of the outer pressure sleeve 55 receives lower pressurized air through the port 92 on the order of 80 to 90 p.s.i.

Referring to the enlarged fragmentation views of FIGS. 3-12 which illustrate additional construction and operation of the tooling assembly 35 or 35' with each stroke of the press, the inner pressure sleeve 80 has an end or nose portion 140 which is normally flush or level with the flat bottom surface of the die center punch insert 68 during the initial downstroke (FIG. 3) and the final up stroke of the upper die shoe 40 (FIG. 11). The nose portion 140 has an annular reverse S-curved surface 143 which includes an outwardly curved bottom end surface 144 and an inwardly curved upper surface 147. The bottom end of the outer pressure sleeve 55 has a slightly arcuate or concaved surface 151 which opposes and mates with an arcuate crown surface 153 formed on the upper end portion 99 of the die core ring 98. The annular upper end portion 99 of the die core ring 98 also has an outwardly curved surface 154, an inclined or frusto-conical surface 156, an inwardly curved surface 157, an outwardly curved surface 158 and an inwardly curved surface 161. The contoured S-shaped surfaces 154, 156, 157 and 158 oppose and mate with the corresponding contoured S-shaped surfaces 147, 143 and 144 on the bottom end of the inner pressure sleeve 80.

Figure 3:
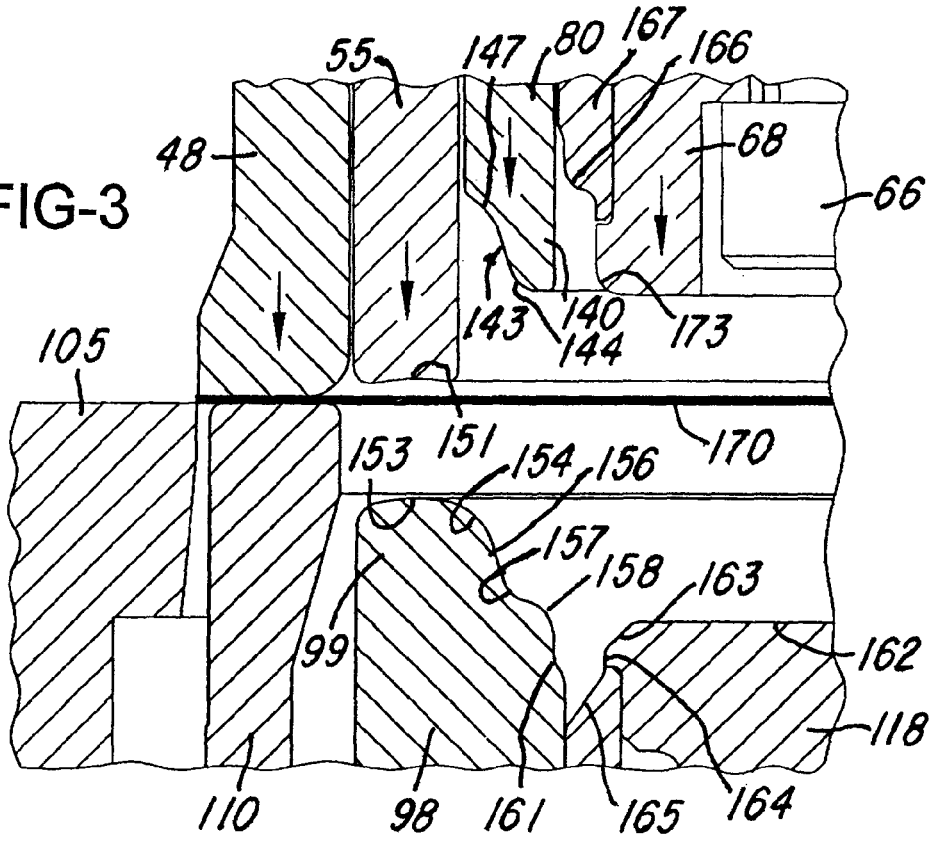
FIGS. 3-11 are enlarged fragmentary sections of the tooling assembly shown in FIGS. 1 and 2 and illustrating the progressive steps for producing a can shell on a single or double action press in accordance with the invention.
Figure 4:
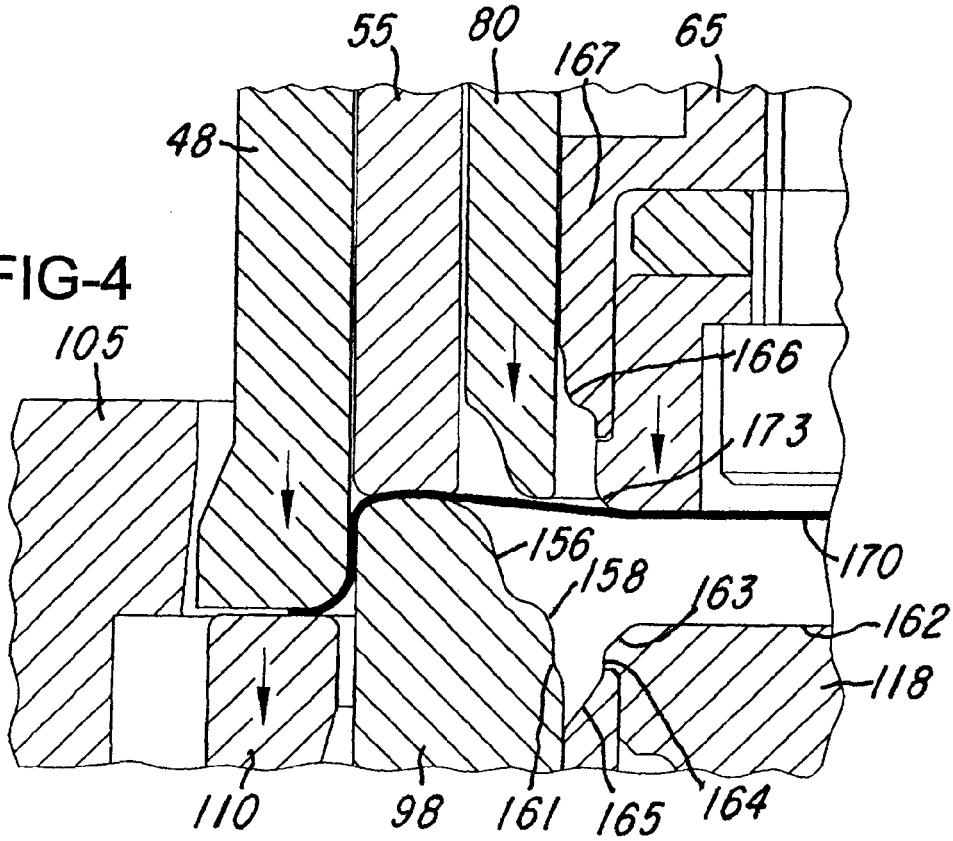

The panel punch 118 has a flat top circular surface 162 surrounded by an inclined or frusto-conical surface 163, a substantial cylindrical surface 164 and an inclined or frusto-conical surface 165 which opposes an S-curved surface 166 on the lower end of a cylindrical skirt portion 167 of the die center punch 65. As shown in FIGS. 3 and 4, as the upper die shoe 40 commences its downstroke, the blank and draw die 48 cooperates with the cut edge die 105 to blank a substantially circular disk 170 of thin sheet metal or aluminum. Continued downstroke of the upper die shoe (FIG. 4) causes an annular portion of the disk 170 to be clamped between the outer pressure sleeve 55 and the die core ring 98 with controlled pressure as determined by the selected air pressure against the piston 56 of the outer pressure sleeve 55. The outer peripheral edge portion of the disk 170 is drawn downwardly around the upper end portion of the die core ring 98 by the downward movement of the blank and draw die 48 and the opposing lower pressure sleeve 110 with the clamping pressure controlled by the selected air pressure within the chamber 114 against the piston 112 of the lower pressure sleeve 110.

Figure 5:
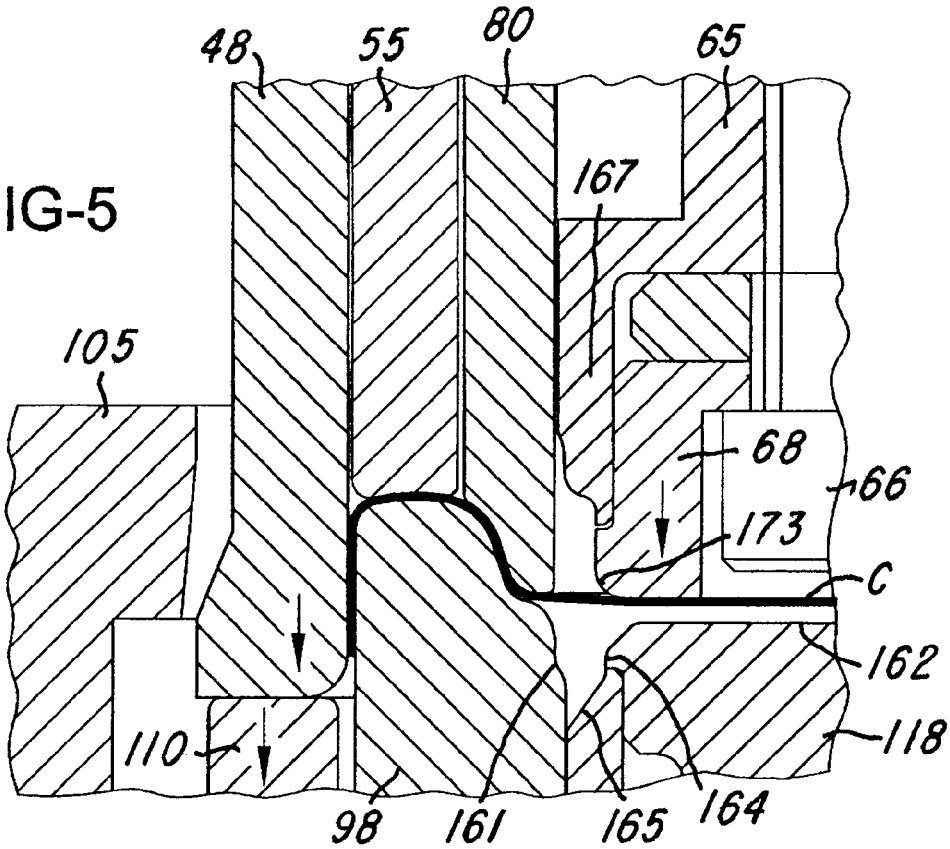
Figure 6:
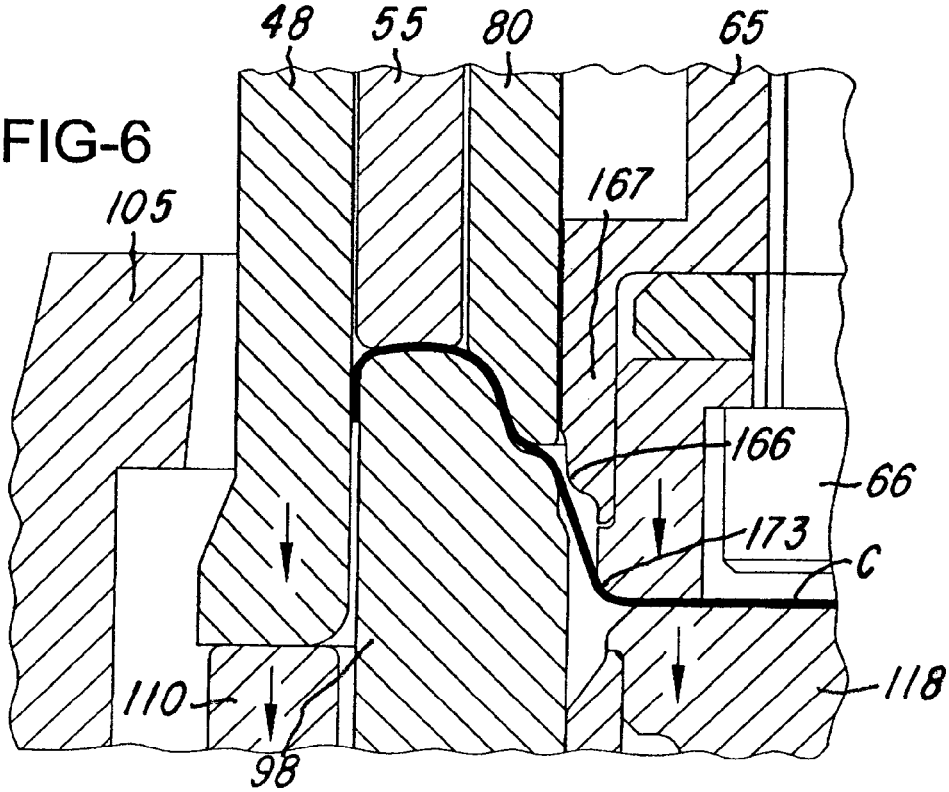
Figure 7:
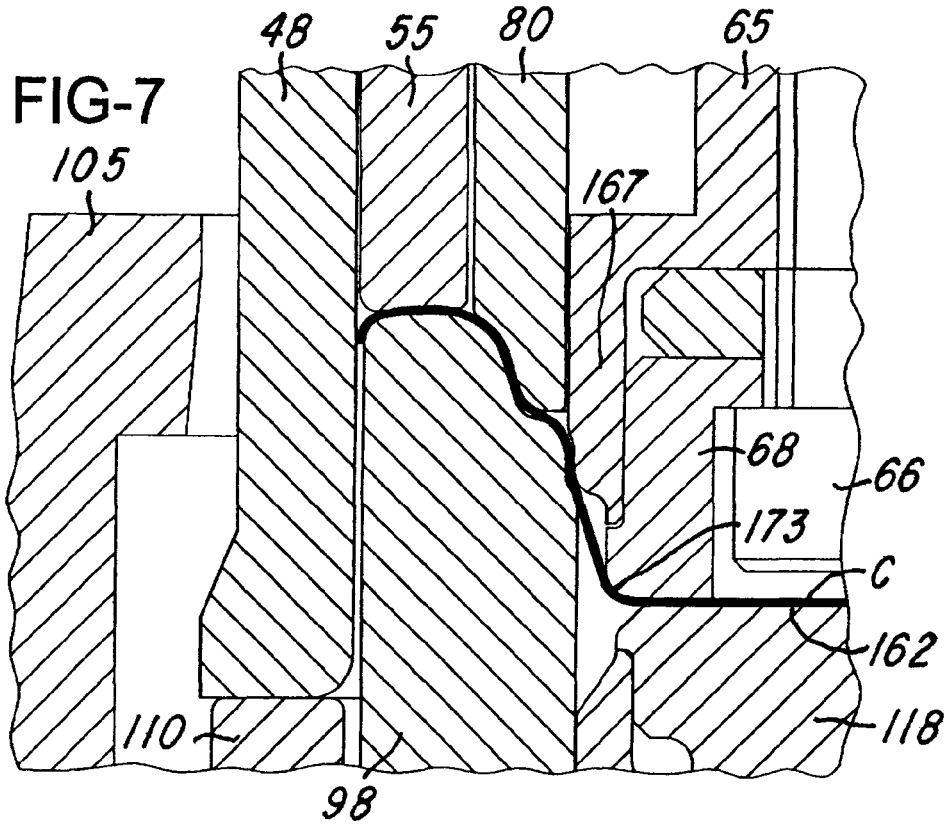
Figure 8:
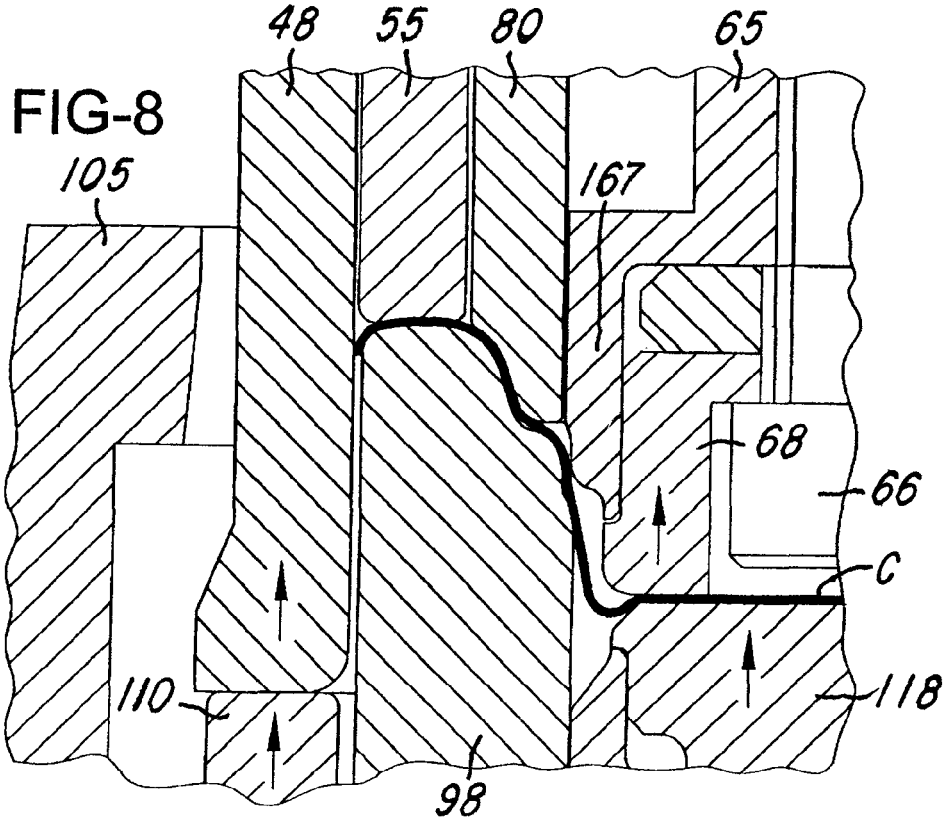
Figure 9:
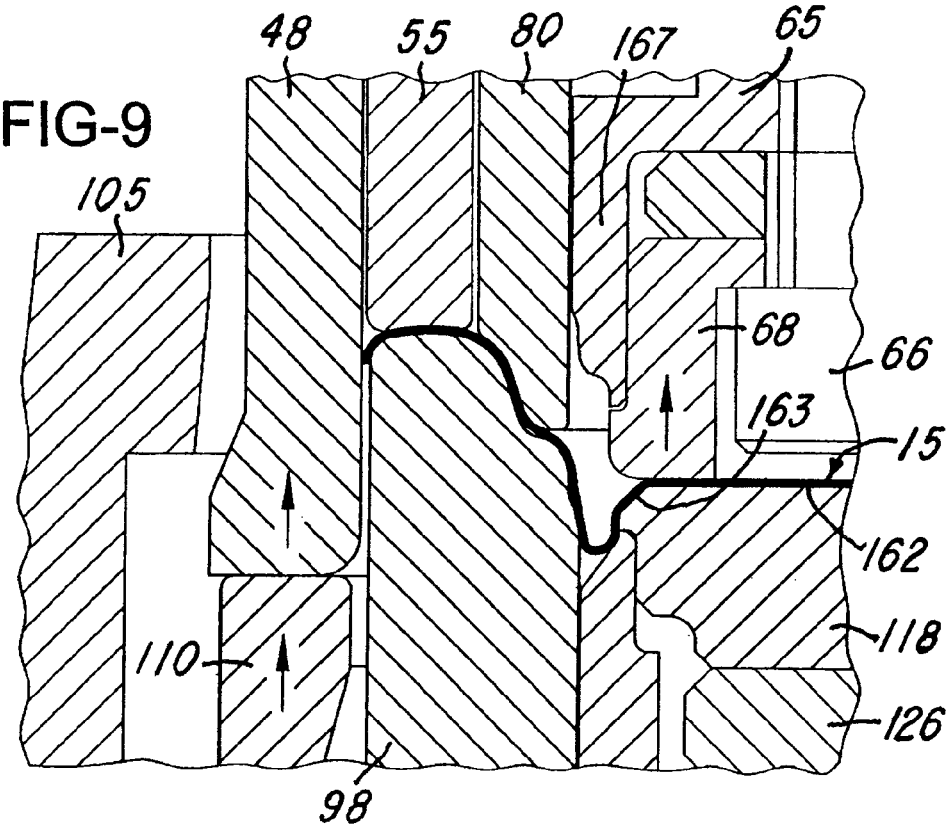

As shown in FIGS. 4 and 5, the die center punch insert 68 has a corner surface 173 with a large radius, larger than the outwardly curved surface 144 of the S-shaped surface 143 on the inner pressure sleeve 80. The punch insert 68 initiates the drawing of a cup portion C (FIG. 5) from a center portion of the disk 170 within the outer pressure sleeve 55 and die core ring 98. The inner crown wall 26 of the shell 15 is formed between the surfaces 147, 143 and 144 on the inner pressure sleeve 80 and the mating surfaces on the die core ring 98 (FIG. 5). Continuing downstroke of the upper die shoe 40 causes the punch insert 68 of the die center punch 65 to cooperate with the pressurized panel punch 118 to continue drawing of the cup portion C while the outer portion of the disk 170 slides between the outer pressure sleeve 55, the die core ring 95 and the blank and draw die 48. As shown in FIG. 7, continued downstroke of the upper die shoe 40 causes the annular skirt portion 167 of the die center punch 65 to extend from the inner pressure sleeve 80 until the contoured end surface 166 on the skirt portion 167 cooperates with the surfaces 158 and 161 to form the chuckwall portions 23 and 24 connected by the slight angular break 25. Simultaneously, the bottom contoured surfaces 143, 144 & 147 of the inner pressure sleeve 80 form and clamp an intermediate annular portion of the disk 170 against the mating contoured surfaces 157, 156 and 154 of the die core ring 98 to form the annular portions 23, 24 and 26 (FIG. 11) of the shell 15. The crown portion 28 and outer curled lip portion 29 of the shell 15 are simultaneously formed on the die core ring 98 with a controlled force on the piston 56 of the outer pressure sleeve 55.

When the upper die shoe 40 of the press arrives at the bottom of its downstroke (FIG. 7) and the piston 56 stops on the shoulder 90 on the die center piston 60, controlled air pressure within the chamber 44 above the die center piston 60 allows the die center piston 60 and die center punch 65 to move slightly upwardly such as by about 0.010 inch. In some presses, this assures that the overall height of all the final shells 15 is always constant and uniform. In other more precisely controlled presses, the die center piston 60 may be fixed to the retainer 38 or 38'.

Figure 10:
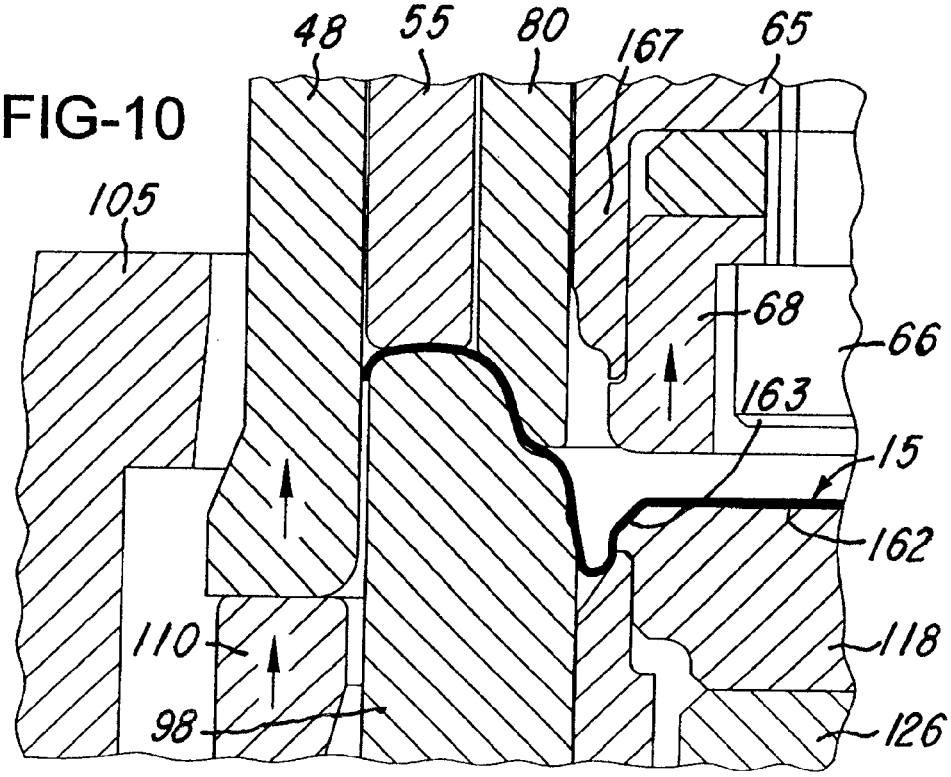

As the die shoe 40 starts the upstroke (FIG. 8), the die center punch 65 moves upwardly as does the opposing lower panel punch 118 while the inner pressure sleeve 80 maintains a controlled constant pressure to hold the shell portions 26 and 28 between the mating surfaces on the inner pressure sleeve 80 and the die core ring 98. This controlled pressure of the inner pressure sleeve 80 is maintained while the panel punch 118 moves upwardly by the force exerted by the panel punch piston 122 so that the peripheral surfaces 163, 164 and 165 form the annular portions 17, 18, 19 and 21 on the shell 15, as shown in FIG. 10. As the upper die shoe 40 continues on its upstroke, the completed shell 15 moves upwardly from the die core ring 98 and panel punch 118 with the upward movement of the outer pressure sleeve 55 as a result of the air jet stream directed upwardly against the panel wall 16 through the center hole 131 in the panel punch 118.

The construction and operation of the tooling assembly 35 or 35' has been found to provide the important and desirable features and advantages set forth above on page 1. For example, the compact tooling assembly is adapted to be operated on a single action mechanical press as well as a double action press, and the reduced overall height of the tooling assembly enables the tooling assembly to be used in most single action high speed presses existing in the field. As another important advantage, the air reservoir chamber 70 and the set of circumferentially spaced air spring passages 88 within the die center piston 60 provide for using lower pressure air within the piston chamber 84, and the lower pressure air on the piston 82 of the inner pressure sleeve 80 reduces the generation of heat in the upper portion of the tooling assembly during high speed operation so that the tooling assembly produces more uniform and precise shells.

The pressurized air within the chamber 70 and/or 91 and the passages 88 or 88' also perform as air springs. These air springs not only reduce the generation of heat, but also provide for precisely selecting the resilient force exerted on the piston 82 of the inner pressure sleeve 80 to assure the desired precise clamping force on the disk 170 by the inner pressure sleeve 80 against the fixed die core ring 98. The tooling assembly 35 also permits the use of the lower pressure plant supply air, such as 70 to 90 p.s.i. to the piston 56 of the outer pressure sleeve 55, and the precisely controlled lower air pressure on the outer pressure sleeve avoids stretching of the sheet metal as the sheet metal slides between the outer pressure sleeve 55, the die core ring 98 and the blank and draw die during formation of the cup portion C.

Further advantages are provided by the construction of the die center punch 65 and punch insert 68 and the die core ring 98 and panel punch 118. For example, the operation and timing of the press with the contoured surfaces on the bottom end of the inner pressure sleeve 80 and the contoured surfaces on the bottom of the skirt portion 167 of the die center punch with respect to the corresponding contoured surfaces on the top end of the die core ring 98 and the peripheral surfaces on the top of the panel punch 118 dependably produce a shell 15 with very uniform wall thickness and without wrinkling or fractures in the sheet metal forming the shell. The tooling can also form the shell with less air pressure which also helps to provide a higher buckle strength for the shell. For example, the air pressure in the port 92 (FIG. 1) may be between 70 and 90 p.s.i. for the piston 56 of the outer pressure sleeve 55, and the air pressure for the port 92 (FIG. 2) for pressurizing both the outer pressure sleeve and the piston 82 for the inner pressure sleeve 80 may be between 110 and 130 p.s.i period. These advantages of lower air pressure result in lower heat which is especially desirable when operating the tooling assembly in a press at high speeds such as 650 strokes per minute with a press stroke of about 1.75 inch. In addition, the contoured surface 166 on the die center punch 65 forms the chuckwall with a precision slight angular break 25 which also increases the buckle strength of the shell. The tooling further provides for forming an inclined panel wall 17 (FIGS. 8 & 9) and countersink 19 in the shell 15 without compressing the sheet metal between dies so that these portions of the shell maintain a precisely uniform thickness and provide a more uniform buckle strength.

While the apparatus or tooling assemblies herein described and their method of operation constitute preferred embodiments of the invention, it is to be understood that the invention is not limited to the precise tooling assemblies and method steps described, and that changes may be made therein without departing from the scope and spirit of the invention as defined in the appended claims.

What is claimed is:

1. A method of forming a cup-shaped circular can shell from a flat metal sheet within a mechanical press, the shell including a center panel connected by an annular panel wall to an annular countersink having a generally U-shaped cross-sectional configuration and with the countersink connected to an annular crown by an inclined annular chuckwall, the method comprising the steps of blanking a disk from the sheet, gripping an annular portion of the disk with controlled pressure between an annular die core ring and an opposing annular outer pressure sleeve, initiating the drawing of a cup from a center portion of the disk with a die center punch insert within an annular skirt portion of a die center punch disposed within an annular inner pressure sleeve, continuing the drawing of the cup until the inner pressure sleeve clamps an inclined annular portion of the cup against the die core ring and forms an inclined inner wall for the annular crown, continuing the drawing of the cup with the die center punch insert cooperating with an opposing panel punch to complete the cup while a contoured outer surface on the die center skirt portion cooperates with a contoured inner surface on the die core ring to form the annular chuckwall of the shell, and reversing the direction of the panel punch and the die center punch while continuing to clamp the annular portion of the cup between the inner pressure sleeve and the die core ring to form the center panel, the panel wall and countersink with surfaces on a peripheral portion of the panel punch.

2. A method as defined in claim 1 and including the step of forming an S-curved end surface on the inner pressure sleeve and an opposing and mating S-curved end surface on the die core ring to form a curved upper portion of the chuckwall.

3. A method as defined in claim 1 and including the steps of forming an annular air chamber between a retainer and a die center piston supporting the die center punch, forming an annular air piston chamber between the die center piston and the outer pressure sleeve, positioning within the air piston chamber an annular piston integral with the inner pressure sleeve, connecting the annular air chamber to the air piston chamber with a plurality of circumferentially spaced air spring passages within the die center piston, and supplying controllable air pressure to the annular air chamber and to the air piston chamber through the air spring passages.

4. A method as defined in claim 3 and including the steps of forming an annular second air piston chamber between the retainer and the die center piston, positioning an annular piston integral with the outer pressure sleeve within the second air piston chamber, and supplying the same controllable air pressure to the annular air piston chamber for the piston on the inner pressure sleeve and the annular second air piston chamber for the piston on the outer pressure sleeve.

5. A method as defined in claim 1 and including the step of locating a removable flat annular spacer between the die center punch and the die center punch insert for precisely positioning the die center punch insert on the die center punch within the skirt portion of the die center punch.

6. A method as defined in claim 1 and including the steps of supporting the die center piston for axial movement within a retainer mounted on a die shoe of the press, and forming an air pressure chamber between the die center piston and the die shoe.

7. A method as defined in claim 1 and including the steps of forming an annular second air piston chamber between the retainer and the die center piston, positioning an annular piston integral with the outer pressure sleeve within the second air piston chamber, and supplying controllable air pressure to the annular air piston chamber for the piston on the outer pressure sleeve lower than the air pressure on the annular second air piston chamber for the piston on the inner pressure sleeve.

8. A method of forming a cup-shaped circular can shell from a flat metal sheet within a mechanical press, the shell including a center panel connected by an annular panel wall to an annular countersink having a generally U-shaped cross-sectional configuration and with the countersink connected to an annular crown by an inclined annular chuckwall, the method comprising the steps of forming an air reservoir chamber within a die center piston supporting a die center punch, forming an annular air piston chamber between the die center piston and an outer pressure sleeve, positioning within the air piston chamber an annular piston integral with an inner pressure sleeve, connecting the air reservoir chamber to the air piston chamber with a plurality of circumferentially spaced air spring passages within the die center piston, supplying controllable air pressure to the air reservoir chamber and to the air piston chamber through the air spring passages, blanking a disk from the sheet, gripping an annular portion of the disk with controlled pressure between an annular die core ring and an opposing annular outer pressure sleeve, initiating the drawing of a cup from a center portion of the disk with a die center punch insert within the die center punch disposed within the inner pressure sleeve, continuing the drawing of the cup until the inner pressure sleeve clamps an inclined annular portion of the cup against the die core ring and forms an inclined inner wall for the annular crown, continuing the drawing of the cup with the die center punch insert cooperating with an opposing panel punch to complete the cup while a contoured outer surface on the die center punch surrounding the die center center punch insert cooperates with a contoured inner surface on the die core ring to form the annular chuckwall of the shell, and reversing the direction of the panel punch and the die center punch while continuing to clamp the annular portion of the cup between the inner pressure sleeve and the die core ring to form the center panel, the panel wall and countersink with surfaces on a peripheral portion of the panel punch.

* * * * *